United States Patent [19]

Earle et al.

[11] 4,058,947

[45] Nov. 22, 1977

[54] FIRE RESISTANT JOINT SYSTEM FOR CONCRETE STRUCTURES

[75] Inventors: Paul Lewis Earle, Denver, Colo.; George William Snider, Chagrin Falls, Ohio

[73] Assignee: Johns-Manville Corporation, Denver, Colo.

[21] Appl. No.: 614,113

[22] Filed: Sept. 17, 1975

[51] Int. Cl.[2] ..... E04F 15/14; E04B 1/68

[52] U.S. Cl. ..... 52/396; 52/404; 52/573; 404/66

[58] Field of Search ..... 260/75, 2, 77.5, 348; 52/396, 468, 471, 573; 404/66, 67, 68, 69, 48; 110/1 A, 1 E; 432/242, 251, 247; 34/242

[56] References Cited

U.S. PATENT DOCUMENTS

| | | | |
|---|---|---|---|
| 1,883,983 | 10/1932 | Lanyon | 110/1 E |
| 1,961,847 | 6/1934 | Fischer | 404/66 |
| 1,992,756 | 2/1935 | Masterson | 110/1 A |
| 2,114,906 | 4/1938 | Nyhagen, Jr. | 52/396 |
| 2,210,138 | 8/1940 | Bishop | 404/66 |
| 2,315,588 | 4/1943 | Brickman | 404/67 |
| 3,111,069 | 11/1963 | Farbish | 52/396 |
| 3,124,047 | 3/1964 | Graham | 52/396 |
| 3,283,674 | 11/1966 | Hahn | 404/67 |
| 3,827,204 | 8/1974 | Walters | 52/396 |

*Primary Examiner*—Price C. Faw, Jr.
*Assistant Examiner*—Robert C. Farber
*Attorney, Agent, or Firm*—Robert M. Krone; Joseph J. Kelly; James W. McClain

[57] ABSTRACT

An improved fire resistive joint system for concrete panel walls and like building structures is disclosed. The cool (or external) side of the joint is sealed by a high performance elastomeric joint sealant, preferably backed up by a closed cell backing material, and the hot (or internal) side of the joint is at least partially filled by a compressible resilient mass of synthetic inorganic refractory fiber.

8 Claims, 5 Drawing Figures

FIRE RESISTANT JOINT SYSTEM FOR CONCRETE STRUCTURES

BACKGROUND OF THE INVENTION

Field of The Invention

The invention herein relates to joint systems for concrete structures. More particularly, it relates to a highly fire resistive joint system for use with walls, floors, ceilings and the like, building structures made of a plurality of adjacent concrete panels.

Many buildings are constructed with precast concrete panels comprising the exterior walls, interior walls, ceilings, floors and/or similar portions of the building structure. Such precast panels, which may also be prestressed, are aligned in a generally abutting relationship and form the vast majority of the wall, ceiling, etc. (For purposes of brievity herein the invention will be illustrated in conjunction with a wall. However, it will be understood that the principles of the invention apply equally to floors, ceilings and like structures.) It is conventional in this type of construction to leave a small gap between the adjacent panels to allow for the normal expansion and contraction of the panels. It is therefore necessary to provide some sort of sealing system to close the gaps (or "joints") between the adjacent panels.

Some joint systems for use in interior locations may be essentially for decorative purposes, while others in interior locations may be to provide privacy separation between adjacent rooms. On exterior walls the joint systems will be primarily for weather-sealing. Similar sealing systems on concrete panels which comprise the lower portion of roof decks will also have a weather-sealing function as well as providing a portion of the base for later overlays of tar and other roofing materials.

All of these various joint systems, whether decorative or functional, suffer a serious deficiency which has long been of concern to the construction industry. This deficiency is their very low resistance to fire. While the concrete panel portions of the walls will resist transmission of flame, heat and fire for one or more hours, the joint systems generally fail in a matter of a few minutes. Consequently, fire starting in one portion of a building can be rapidly transmitted throughout the entire building despite the fire resistance of the concrete panels. This of course presents a very serious public safety hazard, particularly in high-rise buildings where fire may spread not only horizontally throughout a single floor, but also vertically to floors above and below through joints in the ceilings and floors. Construction industry people and public safety officials have therefore long sought to devise effective "fire-resistive" joint systems which would provide functional fire resistance essentially equivalent to that of the concrete panels.

For the purpose of description in this specification, the following terminology will be used.

"side of the joint" — those portions coplanar with the major surfaces of the panels "depth of the joint" — the dimension equivalent to the thickness of the panels "length of the joint" — the dimension equivalent to the abutting length dimension of the panels "one-stage joint" — a joint comprising a straight linear passage (see FIGS. 2 and 3)

"two-stage joint" — a joint having two straight passages with an offset portion or enlarged portion between them (see FIGS. 4 and 5)

"fire-resistance" — the ability of a joint to remain operational for at least one hour in the ASTM E-119 fire test

DESCRIPTION OF THE PRIOR ART

Considerable study of fire resistive concrete walls has been done by concrete construction trade organizations, such as the Prestressed Concrete Institute. A description of exemplary work in this field, including references to other studies, may be found in an article by A. H. Gustaferro, "PCI Report on Fire Resistance of Architectural Precast Concrete", *J. Prestressed Concrete Inst.*, 19, 5, 18–37 (Sep.–Oct. 1974). This article suggests the use of asbestos rope in joint systems (both one-stage and two-stage) to improve fire resistance. Some of the joint systems illustrated in the article incorporate sealants in combination with the asbestos rope on the exterior and/or interior sides of the joints.

BRIEF SUMMARY OF THE INVENTION

The invention herein is an improved fire-resistive joint system comprising in combination a joint sealant on the cold side and a substantial thickness of a compressible resilient mass of synthetic inorganic refractory fiber on the hot side. It has been found that this combination of materials provides a joint having superior fire resistance, and most importantly, provides as well the mechanical characteristics needed to accomodate to the continual expansion-contraction and other motion of the concrete panels of the wall and retain the fire resistant character of the joint. In further and more particular embodiments the joint system also contained a backup member for the sealant. The sealant may also be placed at each side of the joint. Similarly, more than one mass of fiber may be placed in the joint, although the cumulative mass of fiber must be sufficient to provide the total thermal resistance required. The sealant material may be a decorative sealant, but preferably will be a functional weather-sealant. Preferred are those materials known as "high performance sealants", particulary elastomeric materials such as polysulfides, acrylics, silicones polyurethanes and polyurethane polyepoxides.

DETAILED DESCRIPTION AND PREFERRED EMBODIMENTS

The invention herein comprises a superior fire-resistive joint system for use with concrete panel walls and like structures. The components of the joint system of the present invention combine to provide both thermal (fire) resistance and the mechanical functions necessary to preserve that thermal resistance.

Heretofore it has been known to provide thermal resistance by incorporating fire resistive materials into joint systems (see, e.g., the illustrations of proposed joints containing asbestos rope in the article by Gustaferro mentioned above.) However, these prior art joints lack the mechanical characteristics necessary to provide the thermal resistance. The ordinary motions of typical concrete panels, including movement due to heating expansion, cooling contraction, flexing due to variable wind loading and structural movement, subjects common thermal resistance materials such as asbestos to compressive forces from which they cannot mechanically recover. Consequently, the fire resistive materials soon become compressed to the point where they no longer fill the joint and fire and heat readily pass by the thermal barrier, causing the joint to fail rapidly in a fire situation.

This fatal deficiency of the prior art joint systems is entirely obviated by the present invention. The joint system herein not only provides highly effective thermal resistance, leading to joint systems with fire ratings as good as or better than the concrete panels themselves, but in addition provides the mechanical functionality necessary to retain that high degree of thermal resistance over a period of long service life.

Figure 1:
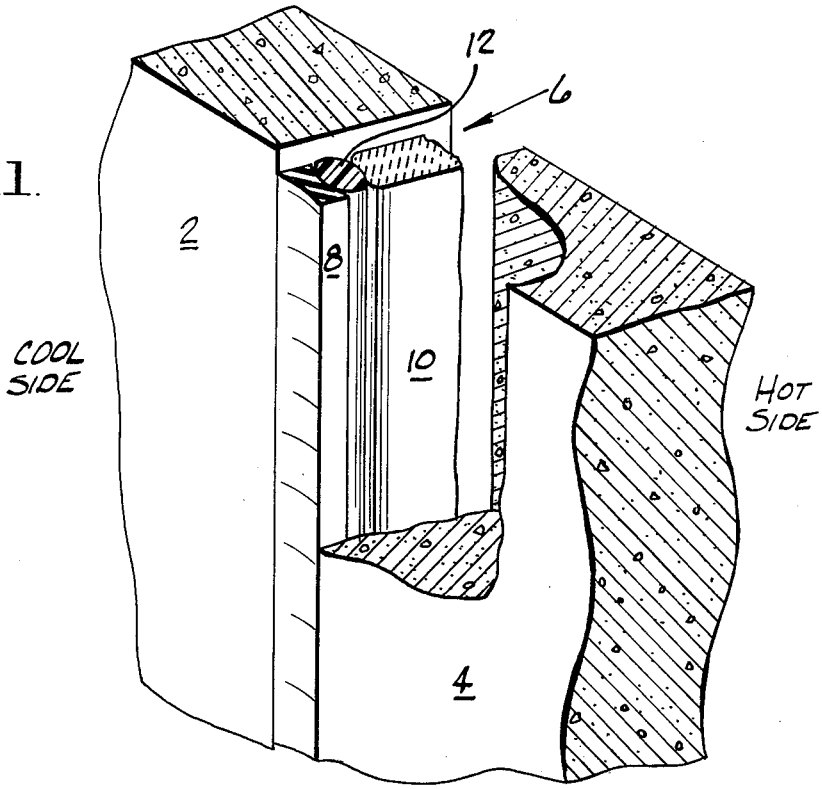
FIG. 1 is a vertical perspective drawing of a small section of a concrete panel wall, illustrating placement of the sealant and fiber of the fire-resistive joint system of the present invention.
Figure 2:
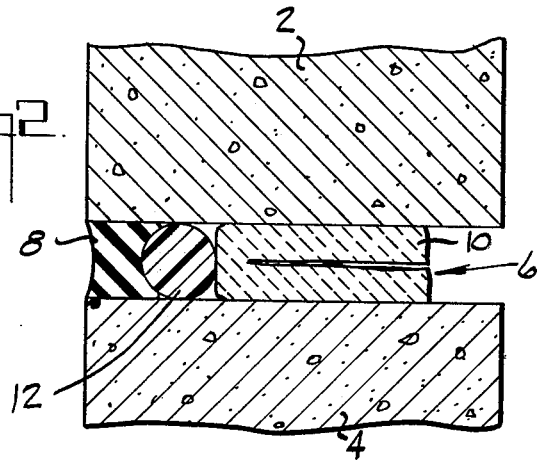
FIGS. 2–5 are horizontal cross-sectional views, illustrating various embodiments of the fire-resistive joint system of this invention.
Figure 3:
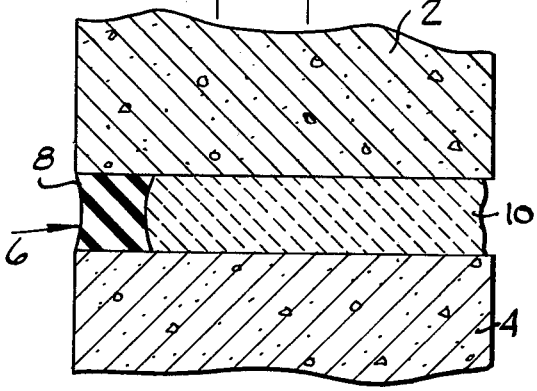

The joint system of the present invention is best understood by reference to the attached drawings. FIG. 1 illustrates a small portion of a vertical concrete wall, focusing on the point where two adjacent panels, designated 2 and 4, abut. Between these two panels is a gap or joint 6. The "hot" or fire side and the "cool" side of the wall and joint are indicated. In many cases these would correspond respectively to the interior and exterior sides of an exterior building wall. A cross-sectional view of this particlar type of simple one-stage joint is also shown in FIGS. 2 and 3.

The joint 6 is sealed and made fire resistive by the combination of two functional materials: the sealant 8 and the refractory fiber mass or batt 10. In the particular embodiment shown the sealant 8 is backed by a backup member 12. Each of these components will be described in detail below.

The sealant 8 completely spans the gap or joint 6 on the cool side and is adhered to the panels 2 and 4 at its opposite sides. Adhesion is preferably obtained by the action of the sealant material itself, although it is also contemplated that there may be instances in which a separate adhesive or primer between the sealant 8 and the panel end surface could be employed. Similarly, the refractory fiber mass 10 also spans the entire width of the joint 6. In the case the fiber mass, retention in the joint 6 is obtained by the frictional forces between the mass 10 and the panel surfaces due to the resilience of the mass. As will be described below, the mass is compressed to a certain extent when emplaced in the joint and its tendency to resile causes it to engage the surface of the ends of the panels and be retained in position. Contrary to the situation with the sealant, it is not generally contemplated that an external adhesive would be used with the refractory fiber mass. This is because such an adhesive would itself tend to transmit the heat and form a bypass around the refractory fiber mass, thus largely defeating the effect of the fire resistant joint. It could be possible, however, to use an inorganic adhesive or a relatively temperature resistive organic adhesive, but such is not preferred. Similarly, an organic or inorganic casing or container for the fiber could also be used, but since that reduces the effectiveness of the joint (see Example 4 below), that is also not preferred.

As will be evident from FIG. 1 the sealant 8 backup component 12 and refractory fiber mass 10 are present as elongated strips, extending the entire length of the joint between the panels. Dimensionally, the joints are commonly found to be on the order of ⅜ to 2 inches in width and generally 4 or more inches in depth. It is important that the depth of the joint be sufficient to allow incorporation of approximately 1½ inches, preferably 3 or more inches, of refractory fiber mass, for the thermal resistance properties of the refractory fiber mass 10 are directly related to the thickness of the mass.

The mass of refractory fiber used in the present invention comprises a compressible but highly resilient mass of synthetic inorganic refractory fibers. Such fibers are normally composed of aluminosilicate and are formed from a melt of silica and alumina, in approximately equal amounts. Such materials are common in the furnace industry where the aluminosilicates are normally rated as "2300° F fibers". Such a rating means that they provide good thermal insulation and thermal resistance at hot surface temperatures of approximately 2300° F. It is also quite common to have small amounts (i.e., up to no more than about 10 to 15%) of other oxides present in the composition of the fibers (i.e., present in the melt from which the fibers are made). The presence of such small amounts of other oxides can serve to raise or lower the thermal rating of the fiber. For instance, the presence of a small amount of chromia (U.S. Pat. No. 3,449,137) yields a fiber having a rating of approximately 2700° F. Other oxides may lower the rating to the neighborhood of 1500°–1600° F. For purposes of the present invention, however, the particular rating of the refractory fiber is not important because all will readily tolerate common flame temperatures of residential and building fires for a period of several hours without melting or sintering. Typical refractory fibers are described in the article entitled "Refractory Fibers" found in the *Encyclopedia of Chemical Technology*, Vol. 17, pages 285–295 (2nd ed: 1968).

For the purposes of this invention the fibrous mass to be used must be composed largely or entirely of the synthetic refractory aluminosilicate fibers (including those having small portions of other oxides as described above). Other synthetic inorganic fibers such as glass wool, silica fibers, the so-called rock wools and mineral wools, and the like (most of which are wholly or predominately siliceous rather than being aluminosilicates) may be present as small portions of the mass, but should not predominate. This is because they do not have high enough temperature ratings to sustain direct flame contact for sufficiently long periods of time without melting or sintering. Further, many of them do not have the mechanical resilience required in the present invention. They may, however, be used to a small amount as fillers in the refractory fiber mass, although because of their thermal and/or mechanical properties they should be dispersed evenly throughout the refractory fiber mass rather than being concentrated in particular locations.

The refractory fiber mass will be in the form of a compressible and resilient batt or the like. A typical commercial material which is ideally suited for use in the present invention is a refractory fiber material sold under the trademark CERABLANKET by the Johns-Manville Corporation. The batt must be thick enough to be compressed for insertion into the joint with sufficient compression that the resulting resilient forces will wedge the batt tightly and permanently into the joint. The batt may be wedged in as a single sheet, as shown in FIG. 3; however, it has been found quite convient to double the batt into "U" shape and, by use of a spatula-like device, to force the doubled-over batt into the joint as illustrated in FIG. 2. Other insertion techniques similar to those used in caulking joints may also be employed. It is important, however, that the batt not be so compressed that the thermal resistance properties of the batt are significantly degraded. It will be recognized by those familar with the insulations field that fibrous batts obtain their high degree of insulating properties because of their light and fluffy nature, whereby many small dead air spaces are encased in the fibrous mass. Consequently, if the batt is compressed too greatly the dead air spaces are significantly eliminated and the thermal insulating properties of the batt will be serverely degraded.

Neither can the refractory fiber batt be substituted for by natural inorganic fibers such as asbestos, although such is proposed by the aforementioned Gustaferro article. Asbestos fibers do not have sufficient mechanical resilience to be retained in position in a joint for an extended period involving repeated expansions and compressions. It is also known that asbestos fiber masses have a decided tendency to "take a set" following compression so that they will not thereafter conform to subsequent motions of the panels and joint.

Organic fiber masses, both natural and synthetic, are ineffective in the present invention, for they do not possess the thermal resistance necessary to resist direct contact with flame for any significant period of time. For the purposes of this invention, therefore, the term "mass of synthetic inorganic refractory fiber" means a fibrous mass containing predominately or completely fibers of aluminosilicate composition (which composition may also contain a small amount of other oxides) as defined above. Where the aluminosilicate fibers are the predominate, rather than total, component of the fibrous mass, the remainder of the mass will be other types of inorganic fibers, also as defined above. Because of their unsuitable mechanical and/or thermal properties, natural inorganic fibers (e.g., asbestos) and organic fibers are excluded from the definition of "mass of synthetic inorganic refractory fiber."

Acting in cooperation with the refractory fiber mass in the present invention is a sealant 8. This material is normally a high-performance elastomeric material which is highly adhesive and which conforms to the expansions, contractions and other motions of the adjacent panels 2 and 4 without any tendency to lose adhesion to either panel. The principal purpose of such a sealant is to provide weather tightness to the joint, although the sealant may also serve a decorative function. However, it is common practice to have the sealant of a somewhat neutral color so that it tends to blend in to the panels visually, so that the casual viewer of the wall will be given the impression of a unitary monolithic concrete wall.

High performance sealant materials which are suitable for use in the present invention include polysulfide elastomers, acrylic elastomers, silicone elastomers, polyurethane, elastomers and polyurethane polyepoxide elastomers. The particular properties of many of these materials which are commercially available are well known and need not be described in detail here. Quite suitable sealants may be found described in many common architectural catalogs. For instance, current volumes of the annual issue of *Sweets' Architectural Catalog* (particularly Section 7.11) normally contain numerous advertisments and descriptions of materials by manufacturers of suitable sealing compounds.

Particularly preferred in the present invention are certain types of polyurethane-polyepoxide based sealants. The principal material for the these sealants is described in U.S. Pat. No. 3,445,436. These materials are particularly preferred because they have been found to have superior adhesive properties, such that they can tolerate large amounts of expansion and contraction of the adjacent panels without loosing significant sealing contact with these panels. Such materials are commercially available from Tremco, Inc. under the trademark DYMERIC.

It is possible to construct a satisfactory joint using only the fiber and sealant, and such is the most basic form of the present invention (see FIG. 3). However, because the fiber batt exhibits a wicking effect and will tend to absorb moisture on the fiber surfaces, preferred joint design calls for the use of the backup material to prevent adverse effects upon the sealant by the water held in the fiber. Therefore, the configuration shown in FIG. 2 is the preferred general form of the invention.

The backup material 12 is normally placed in a joint at the time the sealant is put in to provide a backing for injection of this elastomeric sealant. The backup material is commonly a closed-cell foam polyethylene, neoprene, or some similar material which can be readily wedged into a joint and has sufficient resilience to be retained while the sealant is being implaced. The Gustaferro article shows a typical sealant backup strip in a joint.

Figure 4:
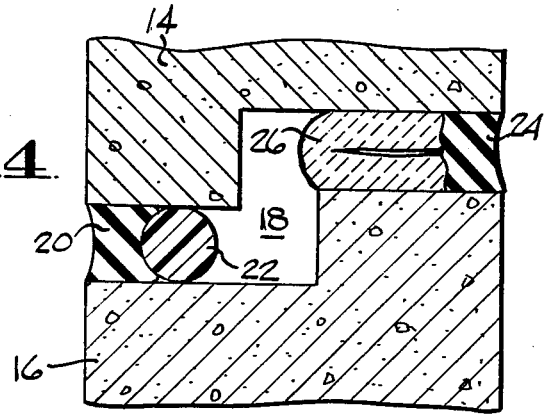
Figure 5:
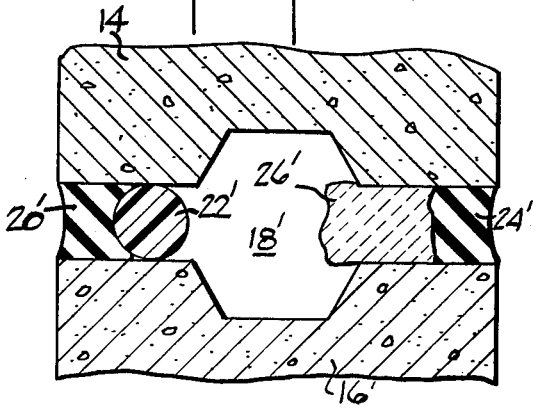

FIGS. 4 and 5 illustrate alternative forms of the joint system of the present invention. In both cases the joint system there shown is known as a two-stage joint because of the air chamber in the middle. Such joint configurations are quite common and are used for improved weather resistance for the buildings. In FIG. 4 the two adjacent panels 14 and 16 have edges configured to provide air space 18 between them. At the exterior side of air space 18 is sealant 20 backed up by backup strip 22. At the opposite of interior side of the joint is another sealant strip 24 (which can be the same material as sealant 20, or different) closing off the opening through which refractory fiber mass 26 was inserted. Similarly, the same type of system is shown in FIG. 5 (with the designation of primed numbers corresponding to the designations in FIG. 4).

The following examples will illustrate in superiorityof the system of the present invention.

Test walls were constructed of three adjacent 1 foot by 3 foot by 5 inch concrete panels with 1 inch joints 5 inches deep between each pair of panels. Test joints were then constructed as noted in the examples below, and each test sample was subjected to the ASTM method E-119 fire test. Under such a test the concrete panels themselves were rated at 2 to 2 ½ hours to failure. Failure is normally measured as the time required for the temperature on the cool side of the joint to reach 250° F (139° C) above ambient, although where flammable materials are involved, such as organic sealants, failure may occur sooner if the material starts to burn.

EXAMPLE 1

The first test joints illustrate the joint systems of the prior art. The exterior of the joints were sealed with the aforementioned DYMERIC polyurethane-polyepoxide sealant compound, backed up by a conventional closed cell foam polyethylene backup material known by the trade designation of "ETHAFOAM." Because of its elastomeric nature the exact depth of the DYMERIC sealant could not be measured but was on the order of approximately ½ inch. The ETHAFOAM backup material was in a cylindrical rope form, slightly larger than 1 inch diameter so that it could be wedged into the joint. Under the ASTM E-119 H test this joint lasted for only 19 minutes before failing by temperature rise.

EXAMPLE 2

A joint system of the type described in Example 1 was constructed using the same materials, with the exception that a batt of a synthetic fibrous aluminosilicate (commercially available under the trademark "CERAFIBER" from Johns-Manville Corporation) was placed in the joint at the fire side to a depth of 1½inches. An air space of approximately 1–2 inches was therefore left between the fiber batt and the backup material. In the fire test this joint lasted 106 minutes before failing by temperature rise.

EXAMPLE 3

A joint similar to that in Example 2 was constructed using the same DYMERIC sealant and ETHAFOAM backup material. The refractory fiber batt was a 3 inch long segment of the above mentioned CERABLANKET material, which is composed of the same type of synthetic aluminosilicate fibers as are present in the above mentioned CERAFIBER material. The 3 inch depth of CERABLANKET was pushed into the joint unitl it was in direct contact with the ETHAFOAM backup rope. In the ASTM E-119 fire test this joint lasted 133 minutes and failed by temperature rise.

It is thus evident from the above data that the joint system of the present invention provides a fire-resistive joint seal which is equivalent to or better than the fire rating of the varied concrete wall which it seals. With this system building walls can be readily constructed to be as fire resistive as the limits of the building materials themselves. Thus, the deficiencies of the past buildings, where the joint seals represented a real "weak link" in the fire safety rating of the building, are entirely obviated by the new system of this invention.

EXAMPLE 4

In another embodiment of the invention herein, a joint was constructed using the DYMERIC sealant as the external sealant. This in turn was backed up by a thinwalled hollow neoprene tube of slightly greater than 1 inch outside diameter. The interior of this tube was filled with a quantity of the aforementioned CERAFIBER synthetic alumino-silicate fiber. The entire joint was then subjected to the E-119 fire test and a rating of 84 minutes was obtained.

What is claimed is:

1. An improved fire resistive joint system for concrete panel building members which comprises an elastomeric joint sealant completely sealing the joint on the cold side of the panels and a compressible resilient mass of synthetic inorganic refractory fiber filling at least the external portion of the joint on the hot side of the panels, said fiber mass having sufficient resilience to maintain continuous operative contact with both sides of the joint during movements of the joint.

2. The fire resistive joint system of claim 1 wherein said synthetic inorganic refractory fiber predominately comprises aluminosilicate composition.

3. The fire resistive joint system of claim 1 wherein said elastomeric joint sealant is selected from the group consisting of polysulfides, acrylics, silicones, polyurethanes, and polyurethane polyepoxides.

4. The fire resistive joint system of claim 3 wherein said elastomeric joint sealant comprises a polyurethane polyepoxide.

5. The fire resistive joint system of claim 2 wherein said elastomeric joint sealant comprises a polyurethane polyepoxide.

6. The fire resistive joint system of claim 1 wherein a closed cell backing member is placed in contact with said elastomeric joint sealant and between the elastomeric joint sealant and said mass of refractory fiber.

7. The fire resistive joint system of claim 1 wherein said mass of refractory fiber substantially fills that portion of the joint not filled by said elastomeric joint sealant.

8. The fire resistive joint system of claim 6 wherein said mass of refractory fiber substantially fills that position of the joint not filled by said elastomeric joint sealant and said backing member.

* * * * *

UNITED STATES PATENT AND TRADEMARK OFFICE

CERTIFICATE OF CORRECTION

PATENT NO. : 4,058,947

DATED : November 22, 1977

INVENTOR(S) : Paul Lewis Earle & George William Snider

It is certified that error appears in the above-identified patent and that said Letters Patent are hereby corrected as shown below:

In the title [54] "Resistant" should read --Resistive--.

In the "[73] Assignee" designation on the cover page, delete "Johns-Manville Corporation, Denver, Colorado" and insert -- Johns-Manville Corporation, Denver, Colorado and Tremco, Inc., Cleveland, Ohio; part interest each --

Column 1, Title, "Resistant" should read --Resistive--.

Column 4, line 67, following "into" insert --a--.

Column 5, line 28, the passage beginning "For the purposes..." should start a new paragraph.

Column 5, line 59, the comma should follow rather than precede "elastomers".

Column 6, line 46, "superiorityof" should read --superiority of--.

UNITED STATES PATENT AND TRADEMARK OFFICE

CERTIFICATE OF CORRECTION

PATENT NO. : 4,058,947

DATED : November 22, 1977

INVENTOR(S) : Paul Lewis Earle & George William Snider

It is certified that error appears in the above-identified patent and that said Letters Patent are hereby corrected as shown below:

Column 7, line 6, following "E-119" delete --H--.

Column 7, line 33, "unitl" should read --until--.

Column 8, line 6, "thinwalled" should read --thin-walled--.

Signed and Sealed this

Second Day of May 1978

[SEAL]

Attest:

RUTH C. MASON
Attesting Officer

LUTRELLE F. PARKER
Acting Commissioner of Patents and Trademarks